US005706893A

United States Patent [19]

Morgan

[11] Patent Number: 5,706,893

[45] Date of Patent: Jan. 13, 1998

[54] TUBING HANGER

[75] Inventor: Michael Graham Morgan, Fife, Scotland

[73] Assignee: FMC Corporation, Chicago, Ill.

[21] Appl. No.: 398,034

[22] Filed: Mar. 3, 1995

[30] Foreign Application Priority Data

Mar. 4, 1994 [GB] United Kingdom ..... 9404220

[51] Int. Cl.[6] ..... E21B 33/04

[52] U.S. Cl. ..... 166/86.1; 166/88.4; 166/75.14

[58] Field of Search ..... 166/86.1, 87.1, 166/88.4, 89.1, 208, 382, 25.14

[56] References Cited

U.S. PATENT DOCUMENTS

| | | | |
|---|---|---|---|
| 3,536,342 | 10/1970 | Hull et al. | 166/89 X |
| 3,603,401 | 9/1971 | Nelson et al. | 166/89 X |
| 3,834,460 | 9/1974 | Brun et al. | 166/89 X |
| 3,897,824 | 8/1975 | Fisher | 166/87 X |
| 4,067,062 | 1/1978 | Baugh | 166/208 X |
| 4,958,686 | 9/1990 | Putch | 166/348 |

FOREIGN PATENT DOCUMENTS

| | | | |
|---|---|---|---|
| 2049765 | 12/1980 | United Kingdom | E21B 34/02 |
| 2214543 | 9/1989 | United Kingdom | E21B 33/043 |

*Primary Examiner*—Roger J. Schoeppel
*Attorney, Agent, or Firm*—Henry C. Query, Jr.

[57] ABSTRACT

A tubing hanger is provided with a production bore and an annulus bore spaced radially outwardly of the production bore. The annulus bore is closed by a valve member in the form of an annular disc that is rotatable by a piston provided in the tubing hanger to move between a position in which the aperture in the valve member is aligned with the annulus bore and a position in which spaced parallel upper and lower surfaces of the valve member close the annulus bore.

12 Claims, 3 Drawing Sheets

TUBING HANGER

BACKGROUND OF THE INVENTION

The invention relates to tubing hangers for use in wells such as oil or gas wells.

It is conventional practice to complete a subsea well with a dual bore tubing hanger with tubing suspended below. One bore is a production bore of between 50 mm and 130 mm nominal diameter and the other is a smaller annulus bore of about 50 mm. The tubing hanger and the associated tubing are run into a subsea wellhead on a running assembly comprising a tubing hanger running tool and a dual bore riser until the tubing hanger is landed and sealed in a wellhead housing. The wellhead carries a BOP stack which is connected to a marine riser through which the tubing hanger is run.

This configuration, with the bores side-by-side is preferred because it is simple to seal off the bores in the tubing hanger. This is done immediately after the tubing hanger has been landed by running and setting at least one plug into each bore through the dual bore riser used to install the tubing hanger using a wireline technique so that the plugs close the bores and secure the well during the time the tubing hanger is exposed to the ambient environment.

Once the plugs are installed, the dual bore riser is disconnected from the tubing hanger and retrieved to the surface after which the BOP stack is disconnected from the subsea wellhead and retrieved to the surface with the marine riser. At this point, the tubing hanger is exposed to the ambient environment. The dual bore riser is re-used to run a christmas tree which is landed and locked into the subsea wellhead simultaneously establishing connections to the tubing hanger. The christmas tree is installed using a running assembly comprising the dual bore riser, a safety package including wireline cutting valves and an emergency disconnect package which allows the separation of the surface vessel in the event that it becomes necessary to disconnect the surface vessel from the wellhead. The dual bore riser leads from the upper end of the emergency disconnect package to the vessel. Wirelines can be deployed through the dual bore riser, the safety package and the christmas tree in order to retrieve the plugs in the production bore and the annulus bore. The christmas tree valves are then shut while the safety package and the dual bore riser are retrieved to the surface. The christmas tree is then capped.

In deeper water, the viability of such a conventional dual bore riser is open to question both from structural and commercial viewpoints. Alternatives to dual bore riser systems utilizing a single bore have been proposed for running and for operating with a christmas tree but, while they can be used for plugging the production bore, they suffer from the problem of providing access to the annulus bore to set and retrieve the annulus bore plugs. Without the facility to use a plug to isolate the annulus bore, it is necessary to provide some sort of valve to isolate the annulus with the valve being included in the tubing hanger.

One proposal in this regard is shown in U.S. Pat. No. 4,807,700 in which a ball valve is provided in a section of the annulus bore in the tubing hanger and is moved by a gear to open and close the annulus bore.

SUMMARY OF THE INVENTION

According to the invention, there is provided a tubing hanger for a well comprising an annular body having two ends, a central bore extending through said body between said ends and at least one annulus bore extending through said body between said ends and spaced radially outwardly of said central bore, said annulus bore being interrupted by a chamber in which is disposed a valve member having spaced parallel surfaces, an aperture extending between said surfaces and said valve member being movable between a position in which said aperture is in register with said annulus bore to permit flow through said annulus bore and a position in which said aperture is out of register with said further passage and said parallel surfaces close said annulus bore.

The following is a more detailed description of an embodiment of the invention, by way of example, reference being made to the accompanying drawing which is a schematic cross sectional view of a portion of an end of the tubing hanger of the present invention split along its longitudinal centerline CL, it being understood that the remainder of the tubing hanger is substantially a mirror image of the portion depicted.

DETAILED DESCRIPTION OF THE PREFERRED EMBODIMENTS

Figure 1:
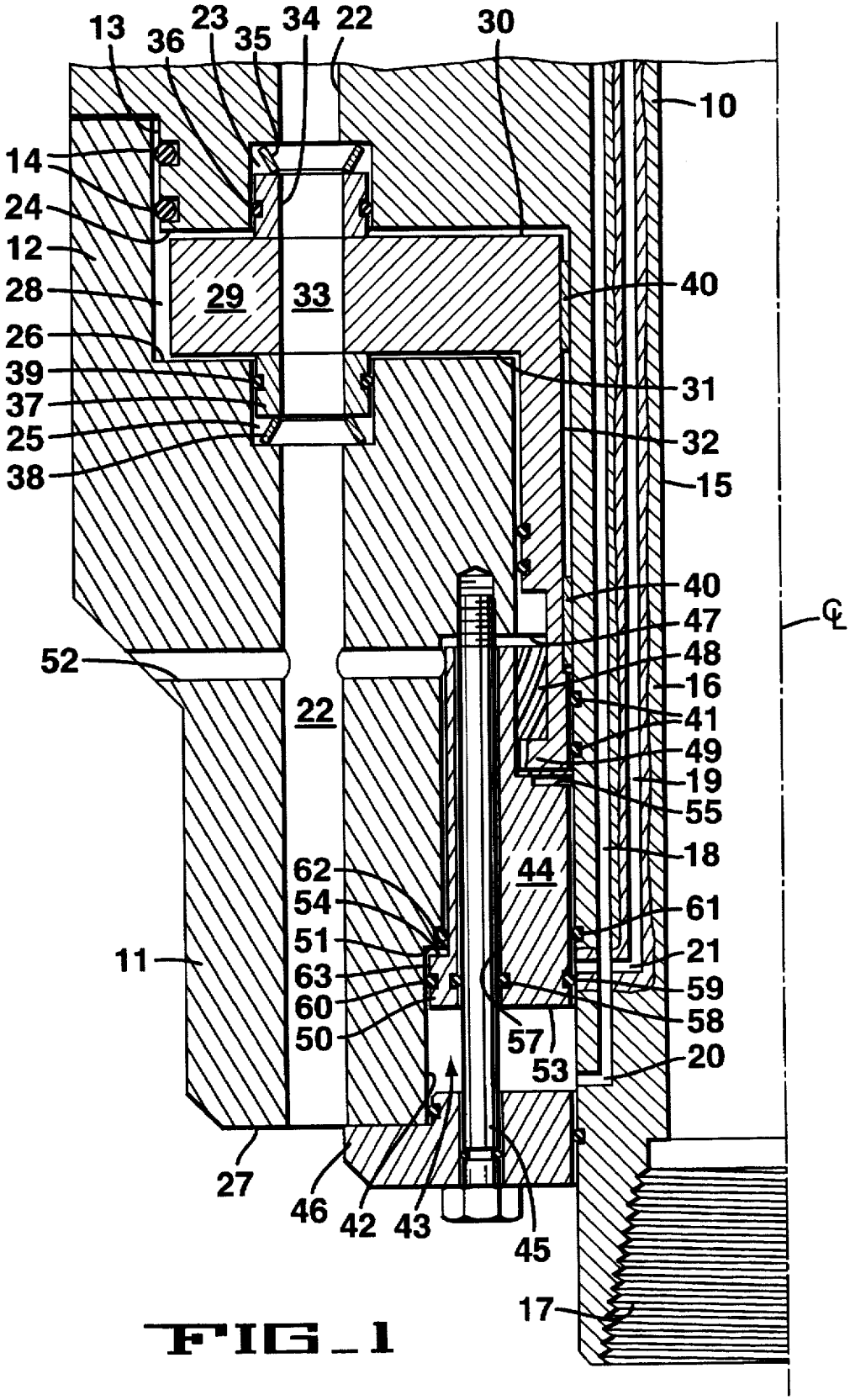
Figure 2:
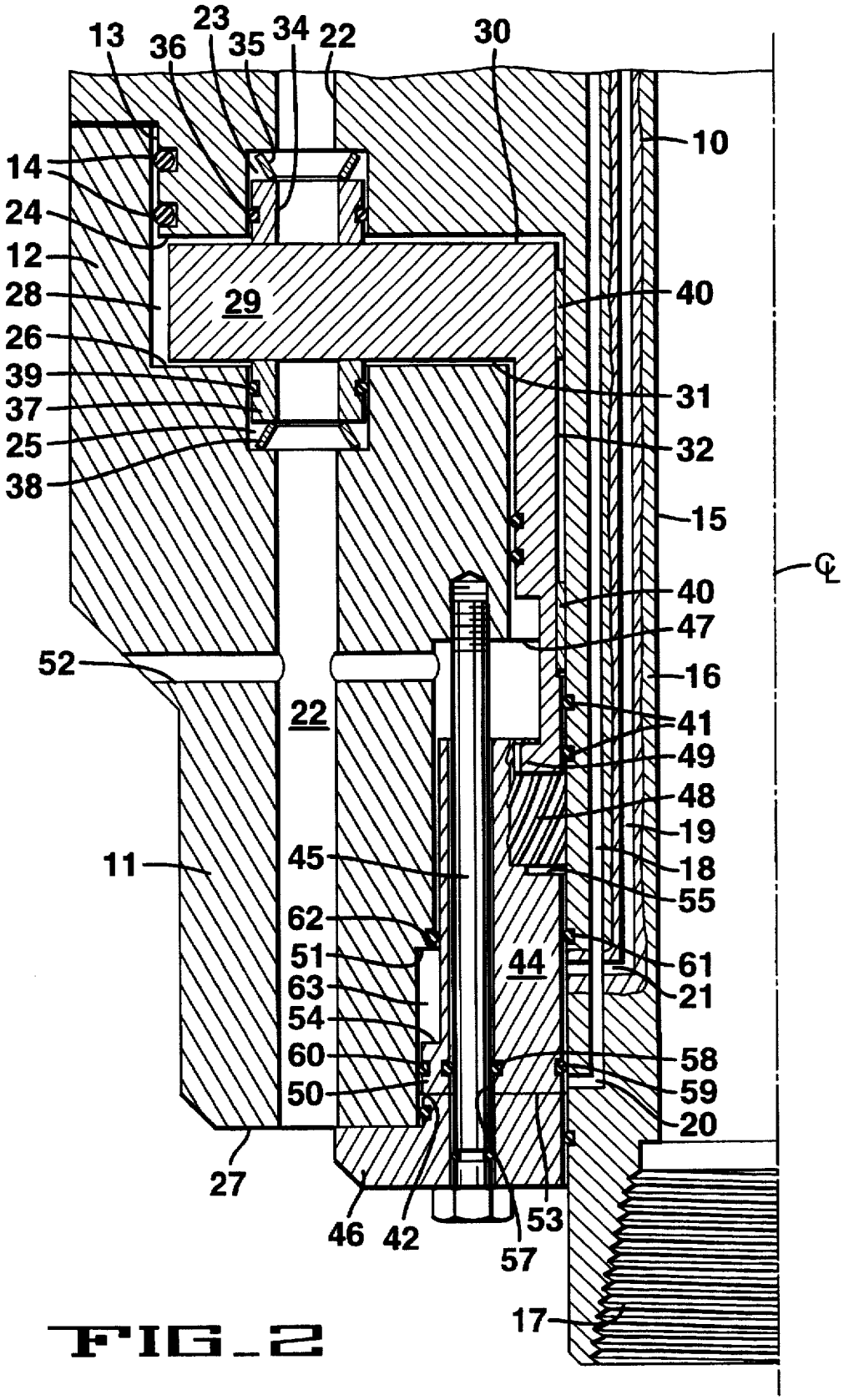
Figure 3:
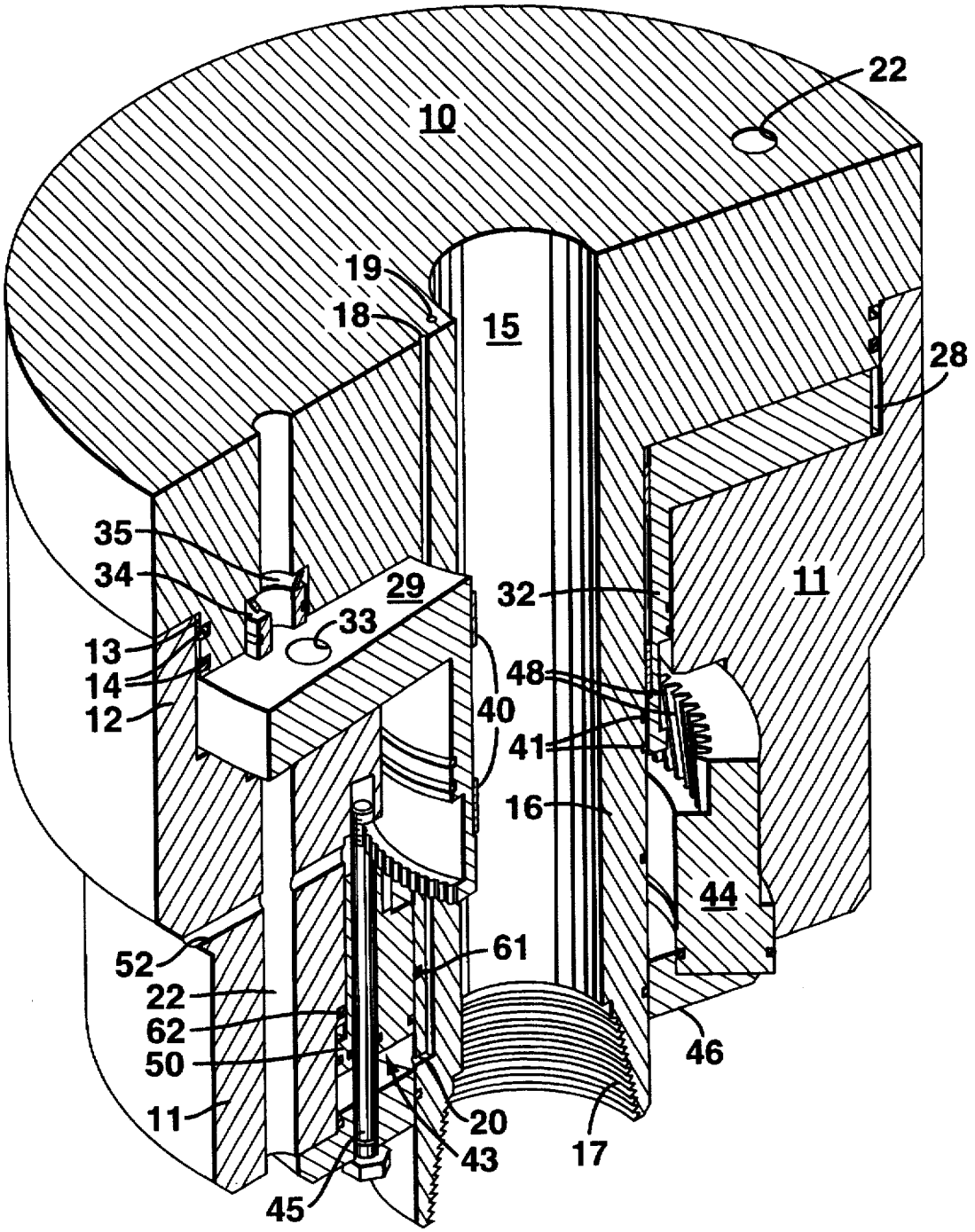

The tubing hanger is formed by an upper portion 10 and a lower portion 11. The lower portion 11 has an axially extending annular flange 12 at an upper end which engages in a co-operating annular rebate provided around a spigot 13 at a lower end of the upper portion, with two annular seals 14 being provided on the spigot 13 to make the joint between the flange 12 and the spigot 13 fluid-tight.

The upper portion 10 is formed with a production bore 15 extending centrally through the portion 10 from an upper end (not shown) to a lower end. As seen in the FIGURE, at the lower end the production bore is formed in a tube 16 that projects from the remainder of the portion 10 and is surrounded by the lower portion 11. The tube 16 ends in a thread 17 for the attachment of production tubing.

Two drillings 18,19 extend through the upper portion 10 and the tube 16 and end in radially outwardly directed ports 20,21 respectively. The function of the drillings and the ports 18,19,20,21 will be described below.

An annulus bore 22 also extends through the upper portion 10 from the upper end (not shown) into a cavity 23 on a lower face 24 of the portion 10. The annulus bore 22 continues from a second cavity 25 provided in an upper end face 26 of the lower portion 11 and emerges as a lower end face 27 of the lower portion 11. As will be seen, the annulus bore 22 is spaced radially outwardly of the production bore 15.

The annulus bore 22 may be one of a number of such annulus bores spaced angularly around the tubing hanger.

The lower end face 24 of the upper portion 10 and the upper end face 26 of the lower portion 11 are parallel annular faces with axes co-axial with the axis of the production bore 15. The faces 24,26 define together with a portion of the outer surface of the tube 16 and a portion of the inner surface of the flange 12, an annular chamber 28 which receives an annular disc-shaped valve member 29 having parallel upper and lower surfaces 30,31 and, at an inner end, a depending sleeve 32 extending around the outer surface of the tube 16.

The valve member 29 is provided with an aperture 33 extending between the surfaces 30,31 and having an axis parallel to the axis of the member 29. The aperture 33, in the position of the valve member shown in the drawing, is aligned with the annulus bore 22. It will be appreciated that where two or more annulus bores are provided, there will be a corresponding number of apertures spaced around the valve member 29 and, in the position of the valve member 29 shown in the drawings, they will be aligned with respective annulus bores.

The upper portion cavity 23 contains an annular seat 34 urged by a spring washer 35 into engagement with the upper surface 30 of the valve member. The seat 34 carries on its outer surface an O-ring seal 36 for engagement with the cavity so providing a fluid-tight seal between the aperture 33 and the portion of the annulus bore 22 in the upper portion 10. A similar seat 37, spring washer 38 and O-ring seal 39 are arranged in the lower portion cavity 25 to provide a fluid-tight seal between the aperture 33 and the portion of the annulus bore 22 in the lower portion 11.

Two annular bearings 40 are provided between the outer surface of the tube 16 and the inner surface of the sleeve 32 in order to mount the valve member 29 for rotational movement in the chamber about an axis co-axial with the axis of the production bore 15. These bearings are protected by a pair of O-ring seals 41 extending around the outer surface of the tube 16 and engaging with the sleeve 32 at positions beneath the bearings 40.

The lower end of the lower portion 11 has an inner annular surface 42 that is spaced radially from the outer surface of the tube 16 to form a second annular chamber 43. An annular piston 44 is disposed in this second chamber 43 and is constrained to sliding movement in a directon parallel to the axis of the production bore 15 by one or more rods extending in a direction parallel to this axis between a cover plate 46, closing the lower end of the second chamber 43, and a step 47 formed in the lower portion 11 at the upper end of the second chamber 43. Each rod 45 extends through a passage 57 in the piston 44. A seal 58 extends around the passage 57 and seals with the rod 45 to prevent fluid passing through the passage 57.

The upper end of the piston 44 is provided with a plurality of helical splines 48 that engage with co-operating splines at the lower end of the sleeve 32. In this way, axial movement of the piston 44 is translated into rotational movement of the valve member 29. The lower end of the piston 44 is provided with a head 50 that engages in an enlarged portion of the second chamber 43 extending between the cover plate 46 and a radial stop surface 51. The downward movement of the piston 44 is limited by engagement of the head 50 with the cover plate 46 and the upper movement of the piston is limited by engagement of the head 50 with the stop surface 51.

The head 50 carries two annular seals 59,60 on the radially inner and outer surfaces of the head 50 respectively to seal with the inner annular surface 42 of the lower portion 11 and the outer surface of the tube 16, respectively. In the position of the piston 44 shown in the drawing, the seals 59,60 are between the cover plate 46 and the port 21.

Two further annular seals 61,62 are provided; one extending around the outer surface of the tube 16 and sealing with the piston 44 and the other extending around the inner surface 42 of the lower portion 11 beyond the step 47 and sealing with the piston 44. These seals 61,62 are spaced axially beyond the port 21 in a direction away from the cover plate 46 so that, with the seals 58,59,60, they define a closed chamber 63 in which is located an upper surface 54 of the piston 44.

The valve member 29 is rotated by supplying fluid under pressure through either the drilling 18 and the port 20 or the drilling 19 and the port 21. The supply of fluid under pressure through the drilling 18 and the port 20 applies pressure to a lower surface 53 of the piston 44 and moves the piston 44 upwardly in the second chamber 43 to the position shown in the drawing in which the aperture 33 is aligned with the annulus bore 22, so allowing flow through the annulus bore. The supply of fluid under pressure through the drilling 19 and the port 21 applies pressure to the upper surface 54 of the piston 44 and moves the piston 44 downwardly in the second chamber 43 and this rotates the valve member 29 to move the aperture 33 out of register with the annulus bore 22. When this happens, the annulus bore 22 is closed by the upper and lower surfaces 30,31 of the valve member. If there are other annulus bores 22 and apertures 33, the arrangement is such that these are closed simultaneously by the surfaces, 30,31. A cross-drilling 52 extends radially through the lower portion 11 to prevent build-up of pressure in the chamber 55 around the upper portion of the piston 44 to prevent the piston 44 forming a hydrostatic lock.

It will be appreciated that the valve member 29 need not be rotated by the use of a piston 44; it could be rotated in any suitable way. Further, the valve member need not be a complete annulus; it could be a part annulus, depending on the number and location of the annulus bores 22. Indeed, the valve member 29 need not rotate; where only one annulus bore 22 is provided, it could perform a rectilinear movement between the position in which the aperture 33 registers with the annulus bore 22 and the position in which the annulus bore 22 is closed by the upper and lower surfaces 30,31.

I claim:

1. A tubing hanger for a well comprising an annular body having two ends, a central bore extending through said body between said ends and at least one annulus bore extending through said body between said ends and spaced radially outwardly of said central bore, said annulus bore being interrupted by a chamber in which is disposed a valve member having spaced parallel surfaces, an aperture extending between said surfaces and said valve member being movable between an open position in which said aperture is in register with said annulus bore to permit flow through said annulus bore and a closed position in which said aperture is out of register with said annulus bore so that said parallel surfaces close said annulus bore.

2. A tubing hanger according to claim 1 wherein said valve member is rotatable about an axis co-axial with the axis of the central bore between said open position and said closed position.

3. A tubing hanger according to claim 2 wherein said chamber has parallel spaced chamber surfaces intersecting said at least one annulus bore at spaced points therealong, said valve surfaces each being adjacent a respective one of said chamber surfaces.

4. A tubing hanger according to claim 3 wherein said chamber and said valve member are annular having respective inner diameters greater than the diameter of the central bore.

5. A tubing hanger according to claim 4 wherein said chamber and said valve member have respective axes co-axial with the axis of the central bore, said chamber surfaces and valve surfaces lying in parallel planes normal to said axis of the central bore.

6. A tubing hanger according to claim 1 and comprising a plurality of further annulus bores relatively angularly spaced around said central bore, said valve member having a corresponding number of apertures and operating to open and close said annulus bores.

7. A tubing hanger according to claim 1 and including drive means operable to move said valve member between said open position and said closed position.

8. A tubing hanger according to claim 7 wherein said valve member is rotatable about an axis coaxial with the axis of the central bore between said open and closed positions and said drive means are operated by fluid under pressure to rotate said valve member between said open and closed positions.

9. A tubing hanger according to claim 8 wherein said drive means includes a piston slidable in a second chamber formed in the body and having two longitudinally spaced-apart surfaces, the fluid under pressure being feedable to said second chamber at either of said two surfaces to move the piston in either direction relative to the second chamber, said piston being so coupled to the valve member that said movements of said piston cause rotation of said valve member between said open position and said closed position.

10. A tubing hanger according to claim 9 wherein said chamber and said valve member have respective axes co-axial with the axis of the central bore, said chamber surfaces and said valve surfaces lying in parallel planes normal to said axis of the central bore, and wherein an annular sleeve projects from said annular valve member and has an end remote from said valve member coupled to said piston, said piston and said second chamber being annular with respective axes co-axial with the axis of the production bore, the piston being slidable axially in said cylinder under the action of said pressurized fluid.

11. A tubing hanger according to claim 10, wherein said piston is coupled to said sleeve by co-operating helical splines provided on said piston and said sleeve respectively.

12. A tubing hanger according to claim 1 wherein sealing means are provided between said valve member and said annulus bore so that, when said valve member is in said open position, said sealing means seal around ends of the aperture to provide a continuous flowpath through the annulus bore and the aperture.

* * * * *